US005134939A

United States Patent [19]

Borne

[11] Patent Number: 5,134,939

[45] Date of Patent: Aug. 4, 1992

[54] DEVICE FOR SHIFTING OSCILLATING ROLLERS IN A PRINTING MACHINE

[75] Inventor: Jean-Louis Borne, Crissier, Switzerland

[73] Assignee: Bobst SA, Switzerland

[21] Appl. No.: 798,825

[22] Filed: Nov. 22, 1991

Related U.S. Application Data

[63] Continuation of Ser. No. 689,539, Apr. 23, 1991, abandoned.

[30] Foreign Application Priority Data

Apr. 23, 1990 [CH] Switzerland ..... 01366/90

[51] Int. Cl.[5] ..... B41F 31/14; B41F 31/16; B41L 27/18

[52] U.S. Cl. ..... 101/349; 101/DIG. 38

[58] Field of Search ..... 101/349, 348, DIG. 38; 91/508, 520, 525, 532, 519, 515, 513, 170 R, 182, 28 G, 220

[56] References Cited

U.S. PATENT DOCUMENTS 3,013,489 12/1961 Moser et al. ..... 101/350
3,179,047 4/1965 Ordway ..... 101/348
4,205,605 6/1980 Greiner et al. ..... 101/206
4,508,013 4/1985 Barbagli ..... 91/517

FOREIGN PATENT DOCUMENTS 0363228 4/1990 European Pat. Off. .
1418944 10/1965 France .
2283780 4/1976 France .
2284451 4/1976 France .
1331849 9/1973 United Kingdom .

*Primary Examiner*—J. Reed Fisher
*Attorney, Agent, or Firm*—Hill, Van Santen, Steadman & Simpson

[57] ABSTRACT

An oscillating roller for offset printing machines has a central shaft fitted for appropriate rotation into a frame of the machine, and a concentric oscillating cylinder. A cotter fitted on the cylinder engages in a guiding groove of the shaft in order to ensure common rotation of the two components without preventing their respective axial shifts. Two chambers made up by the cylinder and the shaft can be alternatively subjected to hydraulic pressure in order to cause the cylinder to shift axially in the one or the other direction.

15 Claims, 6 Drawing Sheets

DEVICE FOR SHIFTING OSCILLATING ROLLERS IN A PRINTING MACHINE

This is a continuation of application Ser. No. 689,539, filed Apr. 23, 1991, now abandoned.

BACKGROUND OF THE INVENTION

The present invention concerns a device for axial shifting of oscillating rollers in a printing machine.

The devices used up to now in printing machines, for instance for offset printing, and which allow an axial shifting of oscillating rollers, are generally mechanically based, for instance on the principle of connecting rods with an eccentric or a similar device. These devices representing the state of the art all have the drawback that they do not allow, or only allow with difficulty, the realization of a centralized remote-control for the following settings:

adaptation of the movement of every oscillating roller to various printing sizes;

setting of the reversing point (which corresponds actually to the location where a very large rotation of the distributing cylinder is to take place with respect to the axial shifting of the corresponding oscillating roller) with reference to the position of the printing plate;

setting of the speed curve and of the range of the axial movement carried out by each oscillating roller.

Moreover, all the settings mentioned above are to be carried out at standstill in order to provide the operator with access to the machine area where the system with the connecting rod and the eccentric is located. Furthermore, a device with a connecting rod and an eccentric results almost in a sinusoidal curve of the shifting speed of the oscillating roller. Similarly, the shifting frequency of the oscillating roller is given by the kinematic chain of the machine.

SUMMARY OF THE INVENTION

An object of the present invention is to allow the realization of a device for shifting all oscillating rollers of a printing machine, the remote-control of the device being easily feasible and without entailing any stoppage of the machine.

According to the invention, a system is provided for axial shifting of a plurality of oscillating rollers in a printing machine. Each oscillating roller has an axially fixed central shaft and a concentric hollow cylinder axially shiftable in both directions with respect to the central shaft. A master hydraulic jack is provided the inner volume of which is subdivided by a movable piston into a first and a second chamber. Each oscillating roller has first and second pressure-tight chambers such that when an over pressure is present within one of them relative to the other one, the cylinder is shifted in the one or the other direction. The plurality of oscillating rollers are connected in closed loop fashion to the master jack such that the first chamber of the master jack connects to a first chamber of one of the oscillating rollers, the second chamber of said one oscillating roller connects to a first chamber of the next oscillating roller, an the outlet of that roller connects in similar fashion to additional oscillating rollers, if any and then back to the second chamber of the master hydraulic jack. Means are provided for shifting the movable piston of the master hydraulic jack in one direction or the other so as to create over pressures through the conduits which enable shifts of the cylinders. A rotary drive means engages with the cylinders of the oscillating rollers for rotating them as they oscillate back and forth.

DESCRIPTION OF THE PREFERRED EMBODIMENTS

Figure 1:
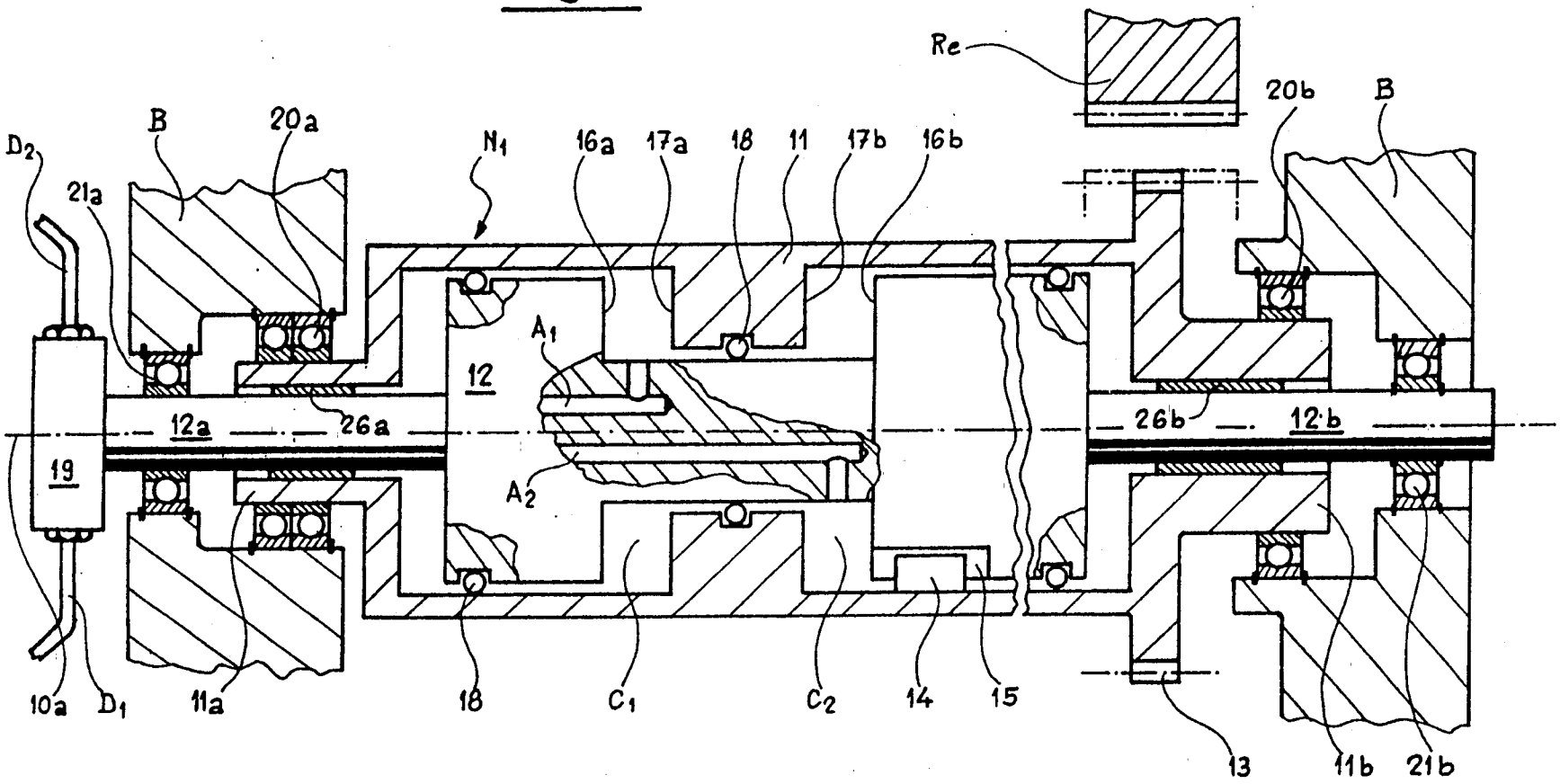
FIG. 1 is a lengthwise sectional view of an oscillating roller according to the invention.

FIG. 1 shows a first oscillating roller $N_1$ of a printing machine which can comprise up to four of such rollers. The oscillating roller $N_1$ consists of a fixed central shaft 12 and a hollow outer cylinder 11 shiftable in parallel with the axle 10*a* of the oscillating roller $N_1$, the cylinder 11 being concentric on the central shaft 12.

At each end, the outer cylinder 11 is extended by a hollow shaft end 11*a* and another one 11*b* which both penetrate with a slight radial backlash into the bores 20*a* and 20*b* of the frame B, thus making up a dust guard for the bearings 21*a*, 21*b*, 26*a*, and 26*b*. The cylinder 11 is provided at least at one of its ends with a toothed rim 13 capable of engaging in a toothed drive wheel $R_e$ of the machine. The teeth of the wheel $R_e$ are broader than those of the rim 13 in order to be able to ensure the drive of the cylinder 11 when the latter shifts from right to left and inversely in order to apply an even layer of ink on the corresponding distributing roller, in line with the state of the art.

Every end 12*a* and 12*b* respectively of the central shaft 12 is fitted so as to be able to rotate on the bearing 21*a* and 21*b* respectively within the frame B. The central shaft 12, axially fixed, is fitted by means of a cotter 14 for joint rotation with the outer cylinder 11. The cotter 14 fitted on the cylinder 11 is engaged, and capable of free sliding, in a groove 15 of the central shaft 12 in order to enable a relative axial shifting between the hollow cylinder 11 and the central shaft 12. Every end 12*a* and 12*b* of the central shaft 12 crosses the hollow shaft end 11*a* and 11*b* respectively. A translation bushing 26*a* and 26*b* respectively is arranged between the two ends 12*a* and 12*b* of the central shaft 12 and the corresponding hollow shaft ends 11*a* and 11*b*.

The hollow cylinder 11 and the central shaft 12 are arranged in such a way as to make up together two circular chambers $C_1$, $C_2$ centered on the axle 10*a*, and axially offset with respect to one another. In other words, every chamber $C_1$ and $C_2$ has a first wall 16*a* and 16*b* consisting of a crosswise shoulder perpendicular to the axle 10*a* of the central shaft 12, and of a second wall 17*a* and 17*b* respectively itself consisting of a crosswise shoulder of the cylinder 11. The tightness of the two chambers $C_1$ and $C_2$ is ensured by the seals 18. Inside the central shaft 12, two ducts $A_1$ and $A_2$ are foreseen, the one duct $A_1$ being connected to the chamber $C_1$, and the other duct $A_2$ being connected to the chamber $C_2$. The two ducts $A_1$ and $A_2$ are fitted within a rotary seal 19 situated at the free end 12*a* of the central shaft 12. As shown schematically by FIG. 2, the duct $A_1$ is connected by means of an outer duct $D_1$ to the first chamber $B_1$ of the main jack M, whereas the duct $A_2$ is connected by means of an outer duct $D_2$ to the second chamber $C_2$ of a second oscillating roller $N_2$ identical to the one illustrated by FIG. 1.

FIG. 1 shows clearly that with the chamber $C_1$ being subjected to overpressure, i.e. a pressure higher than the one existing in chamber $C_2$, the overpressure, provided it is sufficient for overcoming the occurring friction, will act against the wall 17*a* of the cylinder 11 and push the latter to the right-hand side; inversely, with the chamber $C_2$ subjected to overpressure which will act against the wall 17*b* of the cylinder 11 and push it towards the left-hand side, the length of the cylinder stroke is determined by the hydraulic control of the overpressure, as may be seen hereafter.

Figure 2:
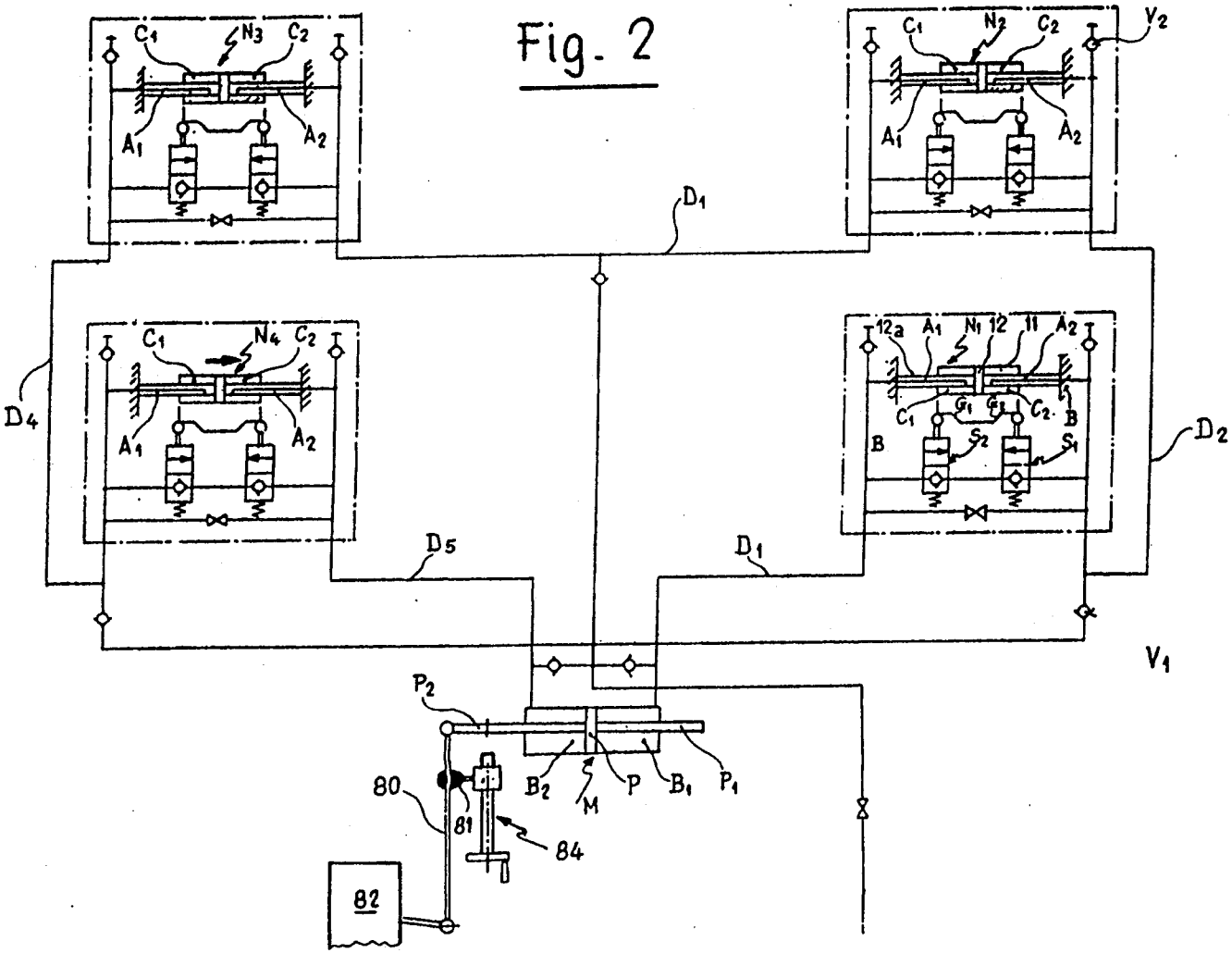
FIG. 2 represents schematically the hydraulic control of the oscillating rollers according to FIG. 1.

FIG. 2 presents schematically the hydraulic shifting control of the four oscillating rollers $N_1$ to $N_4$ which are all similar to those shown by FIG. 1.

The hydraulic control system includes a master or main jack M provided with two chambers $B_1$ and $B_2$ separated from one another by a movable piston P which on its outer part has an extension in the form of two rods $P_1$ and $P_2$. A rod $P_2$ is connected to the free end of a lever 80 capable of tilting around a pivot 81. At its other end, the lever 80 is connected to a driving device 82 purposed for ensuring the tilting of the lever 80 around the pivot 81. The pivot 81 is fitted on a screw-like bushing system 84 so as to allow the positioning of the pivot 81 with regard to the lever 80, and thereby vary the length of the stroke of the piston P. The other rod $P_2$ is to ensure the same movement of oil volumes with the reciprocation of the piston P. As already mentioned, the first chamber $B_1$ of the main jack M is connected directly by means of an outer duct $D_1$ to the duct $A_1$ of the first chamber $C_1$ of the first oscillating roller $N_1$. The second chamber $C_2$ of the oscillating roller $N_1$ is connected, through its duct $A_2$ and an outer duct $D_2$, to the duct $A_2$ of the oscillating roller $N_2$ of which the first chamber $C_1$ is connected, through its duct $A_1$ and an outer duct $D_3$, to the duct $A_2$ of the second chamber $C_2$ of the third oscillating roller $N_3$. The first chamber $C_1$ of the third oscillating roller $N_3$ is connected, through its duct $A_1$ and an outer duct $D_4$, to the duct $A_1$ of the first chamber $C_1$ of the fourth oscillating roller $N_4$ of which the second chamber $C_2$ is connected, through its duct $A_2$ and an outer duct $D_5$, to the second chamber $D_2$ of the main jack M.

In this way, the entire oil circuit described above makes up a closed and tight loop. At standstill, the circuit is held at a pressure of, for instance, 10 bar. FIG. 1 shows that when the two chambers $C_1$ and $C_2$ of an oscillating roller $N_1$ to $N_4$ are under even a pressure of 10 bar, the outer corresponding cylinder 11 will not move. On the other hand, as soon as an overpressure builds up in the one or the other chamber $C_1$ or $C_2$, the cylinder 11 will be caused to move. This overpressure is built up by the motion of the piston P of the main jack M with the help of the drive system 82. Hence, a slight movement of the main jack M towards the right-hand side causes a slight overpressure to build up in chamber $B_1$ and to propagate throughout the hydraulic circuit of the closed loop, bringing about a shift towards the right-hand side of the cylinders 11 of the oscillating rollers $N_1$ and $N_4$ as well as a shift towards the left-hand side of the cylinders 11 of the oscillating rollers $N_2$ and $N_3$. In the event of the piston P being moved towards the right-hand side, every cylinder 11 will obviously move inversely. The hydraulic circuit is also provided with non-return and bleeding valves $V_1$ and $V_2$ respectively. Conspicuously, the entire hydraulic circuit with a closed loop is conceived in such a way as to enable a forward and backward flow of the hydraulic fluid as imposed by the corresponding motion of the piston P of the main jack M.

The driving motion 82 can, for instance, be achieved by means of a cam, an eccentric, or even lever systems.

Figure 6:
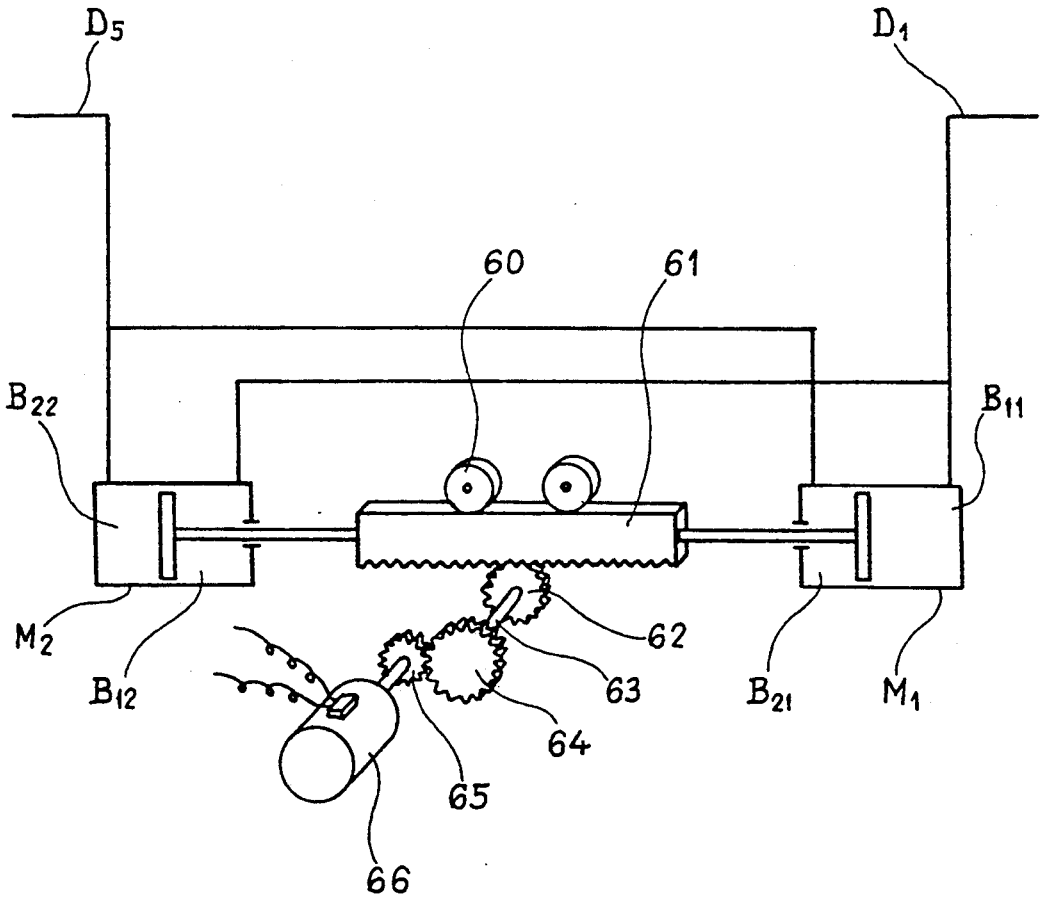
FIG. 6 is a variation of a part of the hydraulic control.

Another conception as illustrated by FIG. 6 has the advantage of providing a larger range of parameters for the movements and their changes when the machine operates. Such a conception includes rollers 60 acting as a support and guide, a rack bar 61, a pinion 62, a shaft 63, and reduction gears 64 and 65, as well as a motor 66.

FIG. 6 illustrates the main jack M in the form of two jacks $M_1$ and $M_2$ known as commercial standard. In fact, in order to avoid the designing of a special master cylinder with a crosswise rod, it will be sufficient to use serially connected standard jacks. Thus, the cumulation of the flow rate of their respective chambers $B_{11}$ and $B_{12}$ as well as $B_{21}$ and $B_{22}$ will provide flow rates equalling the ones of the chambers $B_1$ and $B_2$ of FIG. 2, i.e. $B_1=B_{11}+B_{12}$, and $B_2=B_{21}+B_{22}$.

Figure 3:
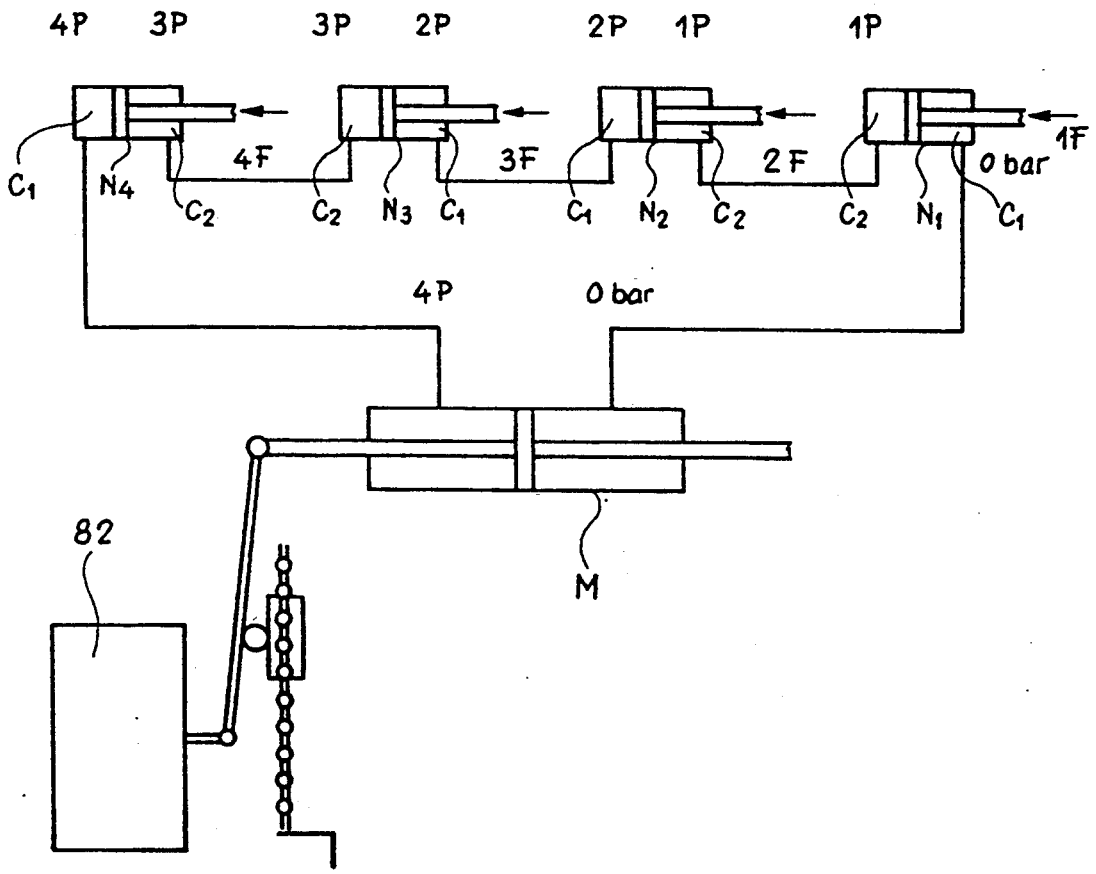
FIG. 3 represents a simplified schematic view of the way the hydraulic control is to operate.

Moreover, if the motor 66 is used, there is a possibility to change:

the movement range;

the movement curve according to the time involved;

the phasing of the movement with respect to the machine angle, i.e. the position of the plate;

the frequency of the movements;

whether the unit is running or at standstill. If consideration is given to the fact, as shown by FIG. 3, that each pair of chambers $C_1$, $C_2$ of the oscillating rollers $N_1$ to $N_4$ is part of a jack of which the pull-out rod of the piston is to operate against a force 1F, i.e. the force necessary for shifting the outer cylinder 11 of every oscillating roller $N_1$ to $N_4$, the hydraulic circuit with the closed loop described above appears as a cascade with the hydraulic pressure as an additional factor.

Consequently, if a pressure difference of 1P between the two chambers $C_1$ and $C_2$ of every oscillating roller $N_1$ to $N_4$ is necessary, the pressure within the chamber $C_1$ of the last oscillating roller $N_4$ and hence also of the second chamber $B_2$ of the main jack M will be equal to 4P. Obviously, the pressure has a high rate and leakages would be harmful to the operation of the system.

Figure 4:
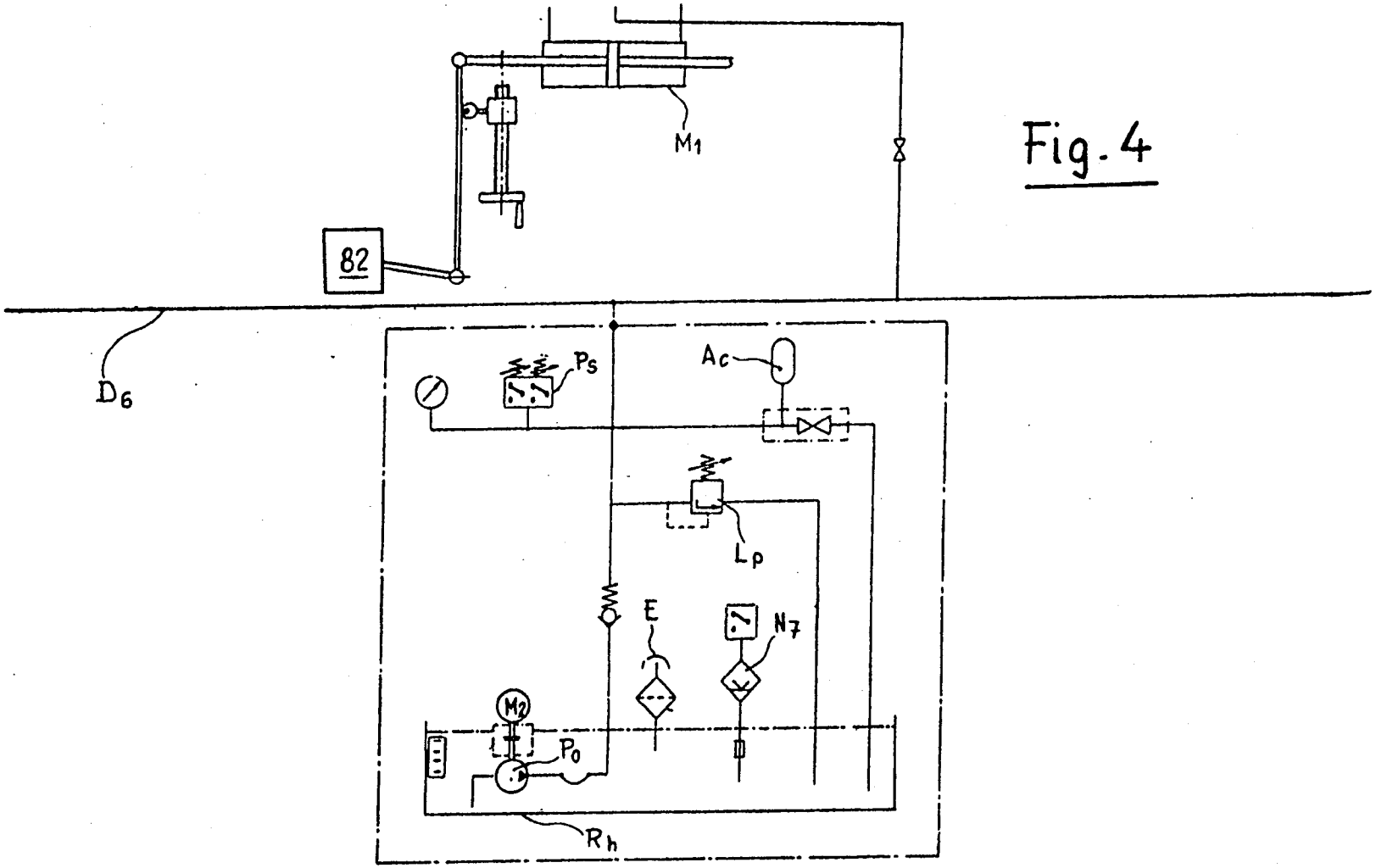
FIG. 4 represents schematically the device for pressure throw-in by means of the hydraulic system.

In order to make up for possible leakages, the hydraulic system is equipped with a hydraulic cramming, or pressure rebuilding, system (FIG. 4). Such a system comprises, according to the state of the art, a motor $M_2$, a pump $P_0$, an oil tank Rh with filling means E provided with a filter Fi and a level control $N_7$, a pressure limiter Lp, an accumulator Ac, and a pressostat Ps. Such a pressure rebuilding system permits, with the printing unit at standstill, i.e. with the oscillating rollers $N_1$ to $N_4$ in a rest position, oil leakages to be made up which might have appeared in the hydraulic circuit with a closed loop. This results by building up the basic or machine standstill pressure. The pressure rebuilding system is connected through a duct $D_6$ to the outer ducts $D_1$, $D_3$, $D_5$ of every printing unit of the machine.

Figure 5:
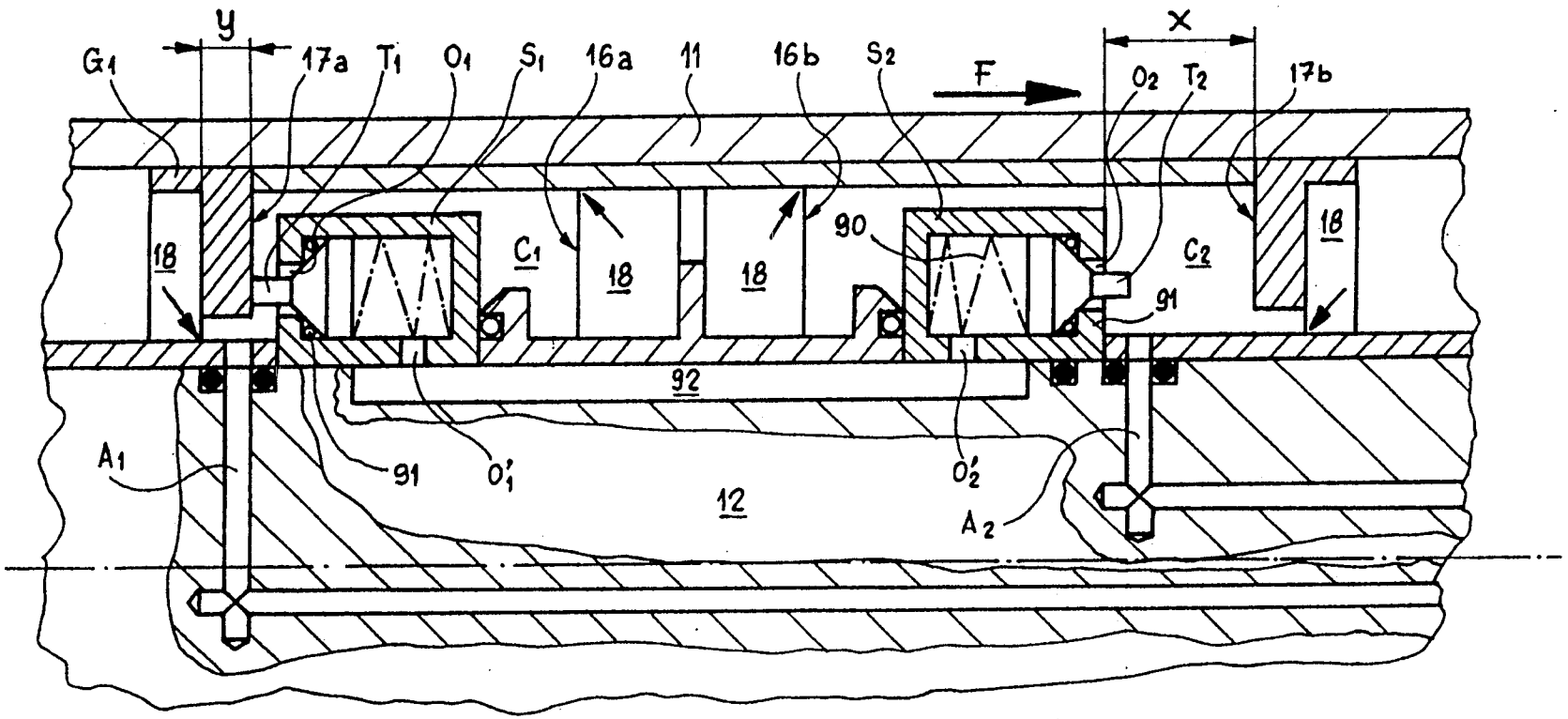
FIG. 5 is another lengthwise partial section of an oscillating roller according to the invention.

Nevertheless, it might happen, for instance in the event of serious leakage due to a defective seal, that at standstill the cylinder 11 might not be centered lengthwise any longer on the shaft 12. In such a case, a crosswise wall 17*a* or 17*b* of the cylinder 11 might knock against the corresponding side 16*a* or 16*b* of the shaft 12. The purpose of FIG. 5 is actually to illustrate how excessive impacts can be avoided on the mechanical end switch stops. Valves $S_1$ and $S_2$ are fitted in every ring-shaped chamber $C_1$, $C_2$ as well as on the periphery of the central shaft 12, the valves being provided with:

a first orifice $O_1$ or $O_2$ respectively connecting its inner volume to the chamber $C_1$ and $C_2$ respectively;

a second orifice $O'_1$ or $O'_2$ respectively, connected to each other through a duct 92 which has the shape of a groove added to the central shaft 12;

a piston $T_1$, $T_2$ protruding from the first orifice $O_1$, $O_2$; and a spring 90, the force direction of which is to push the piston $T_1$, $T_2$ against the seals 91 in order to close the first orifice $O_1$, $O_2$.

If x represents the distance between the movable wall 17*a*, 17*b*, of the cylinder and a fixed component (for instance the valve $S_1$, $S_2$) against which the wall might come to a stop, the valves $S_1$, $S_2$ are designed so that a diminution of the distance x below a rate y previously set (by the manufacturer) causes the pistons $T_1$, $T_2$ to be shifted in the direction in which the orifices $O_1$, $O_2$ open up.

The inner periphery of the hollow cylinder 11 carries two stops $G_1$, $G_2$ of which the one $G_1$ is able at the right-hand stroke end of the cylinder 11 to act on the piston $T_1$ in order to open the orifice $O_1$; considered inversely, at the left-hand stroke end of the cylinder 11, the other stop $G_2$ is able to act on the piston $T_2$ in order to open the orifice $O_2$.

FIG. 5 illustrates the cylinder 11 after its having reached the right-hand stop as shown by the arrow F. The piston $T_1$, having been pushed to the right-hand side by the stop $G_1$, is no longer in contact with the seal 91. At this stage, the pressure in the chamber $C_2$ is higher than the pressure in chamber $C_1$ as well as the pressure contained in the common duct 92 and in the inner volume. With spring 90 of the valve $S_2$, the piston $T_2$ will undergo a left-hand shift which will bring about equality of pressure within the two chambers $C_1$, $C_2$ through the common duct 92. At that stage, the shift of the cylinder 11 is terminated. The subsequent shift of the cylinder 11 towards the left-hand side is able to set in, owing to an overpressure built up within the chamber $C_1$ by the motion of the piston P of the main jack M towards the left-hand side. Attention is to be drawn to the fact that FIG. 2 represents schematically the stops $G_1$, $G_2$ in the form of a cam with two curves fitted on the cylinder 11 and actuating the pull-out rod of the valves $S_1$, $S_2$.

Another feature to be mentioned is that this compensation system for pressure equality activates when the chambers and the hydraulic ducts are filled.

Obviously, numerous modifications can be added to the above-mentioned way of realization, without overstepping the limits of the invention. Thus, for instance, the chambers drafted over the whole active width of the oscillating roller on FIG. 1 can be, and will be, usefully concentrated at the left-hand end of the figure on account of the fact that the axial strokes have a rate of +20 mm (as indicated with mixed lines). This arrangement permits use of practically the entire oscillating roller for a cooling system, which is very common equipment and has a rotary connection at the end opposite 19. (The design according to FIG. 5 already includes the preceding remarks.)

Although various minor changes and modifications might be proposed by those skilled in the art, it will be understood that I wish to include within the claims of the patent warranted hereon all such changes and modifications as reasonably come within my contribution to the art.

I claim as my invention:

1. A system for axial shifting of at least first and second oscillating rollers in a printing machine, comprising:

at least first and second oscillating rollers each being formed of an axially fixed central shaft in a concentric hollow cylinder which is axially shiftable in both directions with respect to the central shaft;

a master hydraulic jack having an inner volume subdivided by a movable piston into first and second chambers;

each of the first and second oscillating rollers having first and second pressure-tight chambers and means for introducing over pressure into one of the pressure-tight chambers relative to the other so as to cause the cylinder to axially shift in one direction or the other;

conduit means for interconnecting the at least first and second oscillating rollers to the master hydraulic jack in a closed loop hydraulic circuit such that a constant pressure is maintained when the oscillating rollers are at stand still, said conduit means comprising a conduit connecting the first chamber of the master hydraulic jack to the first chamber of the first oscillating roller, connecting the second chamber of the first oscillating roller to the first chamber of the second oscillating roller, and connecting the second chamber of the second oscillating roller back to the second chamber of the master hydraulic jack;

shifting means for shifting a piston of the master jack in one direction or the other so as to build up over pressures within the closed loop hydraulic circuit, said over pressures enabling back and forth shifts of the at least first and second oscillating rollers; and rotary drive means for rotating each of the cylinders of each of the at least first and second oscillating rollers.

2. A system according to claim 1 wherein more than two of said oscillating rollers are connected in said hydraulic circuit closed loop and wherein the second chamber of the second oscillating roller connects through conduit to the additional rollers then through conduit back to the second chamber of the master hydraulic jack.

3. A system according to claim 1 wherein each first and second pressure-tight chamber of each oscillating roller has a shape of a ring-shaped envelope situated between the central shaft and the cylinder, the pressure-tight chambers being axially limited by a first crosswise surface on the central shaft and by a second crosswise surface of the hollow cylinder, each pressure-tight chamber being connected to an inner conduit which connects to the conduits of the closed loop.

4. A system according to claim 3 wherein each oscillating roller has means for rotary connection of the central shaft to the hollow cylinder, and wherein the inner conduits connect to the closed loop conduits by a rotary seal.

5. A system according to claim 1 wherein the shifting means for the piston of the master jack comprises means for setting a shifting speed of the piston and a reversing point of the piston.

6. A system according to claim 5 wherein said means for setting comprises a lever tilting around a movable pivot, a first end of the lever engaging an outlet rod of the piston, and a second end of the lever connecting to a driving device.

7. A system according to claim 1 wherein the driving means for the master hydraulic jack piston comprises a lever, a first end of the lever connecting to an outlet rod of the piston, a second end of the lever connecting to a drive system, and a movable pivot point slidable along the lever for adjusting a range of operation of the piston within the jack.

8. A system according to claim 1 wherein each of the oscillating rollers has means for pressure compensation between the first and second chambers when the concentric hollow cylinder is close to an end of its motion range in one or the other direction.

9. A system according to claim 8 wherein said pressure compensation means comprises respective first and second valves at respective first and second ends of the axial shaft within the concentric hollow cylinder, first and second respective stop means on the cylinder for activating the respective first and second valves, and a common conduit connecting the first and second valves, a pressure compensation occurring through said common conduit when said valves are activated in a vicinity of ends of said motion range at said stop means.

10. A system according to claim 1 wherein each chamber of each oscillating roller has first and second respective fixed valves mounted on the central shaft and each provided with a piston and a first orifice, first and second stop means mounted on each cylinder at an outer end of each respective first and second pressure-tight chamber, said piston being positioned such that an extension of the piston passes through the first orifice and abuts against the respective first or second stop means, and wherein a second orifice is provided in each of said valves with a common connecting duct therebetween, and wherein at an end of a motion range of the cylinder the respective pistons are activated by the respective stop means.

11. A system according to claim 1 wherein means is provided for putting the closed loop hydraulic system under pressure.

12. A system according to claim 1 wherein said shifting means for shifting the position of the piston of the main hydraulic jack in the one direction or the other comprises a rack bar connected to the piston and with means for permitting translational movement of the rack bar, a pinion engaging with the rack bar, reduction gear means for driving the pinion, and motor means for driving the reduction gear means wherein a variance of drive of the motor means allows motion parameters to be varied.

13. A system according to claim 1 wherein said master jack comprises first and second jack parts positioned opposite one another with respective first and second pistons which are connected to one another.

14. A system according to claim 1 wherein each oscillating roller has means for locking a rotation of the cylinder to the central shaft.

15. A system for axial shifting of at least first and second printing machine oscillating rollers, comprising:

at least first and second printing machine oscillating rollers each being formed of a central shaft in a hollow cylinder which is axially shiftable in both directions with respect to the central shaft;

a master hydraulic cylinder means having first and second pressure chambers with a piston;

each of the first and second oscillating rollers having two pressure-tight chambers and means for introducing over pressure into one of the pressure-tight chambers relative to the other so as to cause the cylinder to axially shift in one direction or the other;

circuit means for interconnecting the at least first and second oscillating rollers in series across the master hydraulic jack in a closed loop hydraulic circuit such that a constant pressure is maintained when the oscillating rollers are at stand still, said conduit means comprising a conduit connecting one of the chambers of the master hydraulic cylinder means to one of the chambers of the first oscillating roller, connecting the other chamber of the first oscillating roller to one of the chambers of the second oscillating roller, and connecting the other chamber of the second oscillating roller back to the other chamber of the master hydraulic cylinder means;

means for changing a pressure in one of the chambers of the master cylinder relative to the other chamber so as to build up over pressures within the closed loop hydraulic circuit, said over pressures enabling back and forth shifts of the at least first and second oscillating rollers; and rotary drive means for rotating each of the cylinders of each of the at least first and second oscillating rollers.

* * * * *